US008834206B2

(12) United States Patent
Tao et al.

(10) Patent No.: US 8,834,206 B2
(45) Date of Patent: Sep. 16, 2014

(54) ELECTRICAL CONNECTOR WITH GROUNGING PLATE

(71) Applicants: Xun-San Tao, Kunshan (CN); Hong-Qiang Han, Kunshan (CN); Zi-Qiang Zhu, Kunshan (CN)

(72) Inventors: Xun-San Tao, Kunshan (CN); Hong-Qiang Han, Kunshan (CN); Zi-Qiang Zhu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 62 days.

(21) Appl. No.: 13/733,854

(22) Filed: Jan. 3, 2013

(65) Prior Publication Data

US 2013/0178101 A1 Jul. 11, 2013

(30) Foreign Application Priority Data

Jan. 5, 2012 (CN) ..... 201220002156
Jan. 5, 2012 (CN) ..... 201220002174

(51) Int. Cl.
*H01R 13/648* (2006.01)
*H01R 13/6583* (2011.01)
*H01R 13/6594* (2011.01)
*H01R 13/6581* (2011.01)

(52) U.S. Cl.
CPC ..... *H01R 13/6581* (2013.01); *H01R 13/6583* (2013.01); *H01R 13/6594* (2013.01)
USPC ..... 439/607.55; 439/607.19

(58) Field of Classification Search
USPC ..... 439/607.17–607.19, 607.28, 607.3, 439/607.55–607.57
See application file for complete search history.

(56) References Cited

U.S. PATENT DOCUMENTS

| | | | | |
|---|---|---|---|---|
| 4,470,657 | A * | 9/1984 | Deacon | 439/607.18 |
| 5,735,712 | A * | 4/1998 | Haas et al. | 439/607.28 |
| 6,147,485 | A * | 11/2000 | Halliday et al. | 324/756.01 |
| 6,604,964 | B2 * | 8/2003 | Hoshino et al. | 439/607.55 |
| 6,743,047 | B2 * | 6/2004 | Korsunsky et al. | 439/540.1 |
| 2002/0132518 | A1 * | 9/2002 | Kobayashi | 439/496 |
| 2012/0094508 | A1 * | 4/2012 | Tao et al. | 439/76.1 |
| 2012/0178291 | A1 * | 7/2012 | Matsumoto et al. | 439/588 |
| 2013/0178101 | A1 * | 7/2013 | Tao et al. | 439/607.53 |

FOREIGN PATENT DOCUMENTS

CN 1202749 C 12/1998

* cited by examiner

*Primary Examiner* — James Harvey
(74) *Attorney, Agent, or Firm* — Wei Te Chung; Ming Chieh Chang

(57) ABSTRACT

An electrical connector 100 includes an insulative housing 1, a plurality of contacts 2, a metal shell 3 and a grounding plate 4. The metal shell 3 includes a front shell 31 having a top wall 311 and an assembling portion 318 extending upwardly from the top wall 311 and having an accommodating slot 3181. The grounding plate 4 includes a base portion 41 inserted into the accommodating slot 3181 and a protruding portion 42 having an elastic mating portion 423 connected with a mating connector. The metal shell 3 further has a rear shell 32 having a vertical covering plate 321 having a resisting portion 3211 extending upwardly and a shielding plate 323 extending forwardly from a top of the covering plate 321. The resisting portion 3211 upwardly abuts against the top wall 311. The grounding plate 4 would be easily assembled to the metal shell 3.

19 Claims, 7 Drawing Sheets

ELECTRICAL CONNECTOR WITH GROUNGING PLATE

BACKGROUND OF THE INVENTION

1. Field of the Invention

The present invention generally relates to an electrical connector and more particularly to an electrical connector with a grounding plate which is mechanically retained to a metal shell of the electrical connector.

2. Description of Related Art

Chinese patent No. 1202749C, published on Dec. 23, 1998, discloses an electrical connector including an insulative housing, a plurality of contacts retained in the insulative housing, a metal shell enclosing the insulative housing and a plurality of grounding plates assembled to the metal shell to connect with a mating shell. The grounding plate has a body portion and an elastic resisting portion extending backwardly and aslant from the body portion, a plurality of through holes pass through a front of the metal shell along a top to bottom direction, the through hole is smaller than the body portion of the grounding plate. When assembly, firstly, the grounding plate is retained in a front of the insulative housing, then the metal shell is mounted to the insulative housing along a front-to-back direction. The resisting portion of the grounding plate extends through the through hole of the metal shell to the exterior upwardly for connecting with a mating connector. The body portion of the grounding plate is located between the metal shell and the insulative housing. However, the grounding plate would be dropped away from the insulative housing during the metal shell is mounted to the insulative housing, that cause an assembly process of the grounding plate be complex.

So, an improved connector is needed.

SUMMARY OF THE INVENTION

The present invention provides an electrical connector, which comprises an insulative housing, a plurality of contacts retained in the insulative housing, a metal shell enclosing the insulative housing and at least one grounding plate assembled to the metal shell for abutting against a mating connector. The metal shell have a front shell having a top wall and at least one assembling portion protruding outwardly from a front of the top wall, the assembling portion has an accommodating slot. The grounding plate has a base portion mounted in the accommodating slot and an protruding portion extending forwardly from the base portion and out of the accommodating slot, the protruding portion has an elastic mating portion disposed outside the top wall for contacting with the mating connector.

Other objects, advantages and novel features of the present invention will become more apparent from the following detailed description of the present embodiment when taken in conjunction with the accompanying drawings.

DETAILED DESCRIPTION OF THE INVENTION

Figure 1:
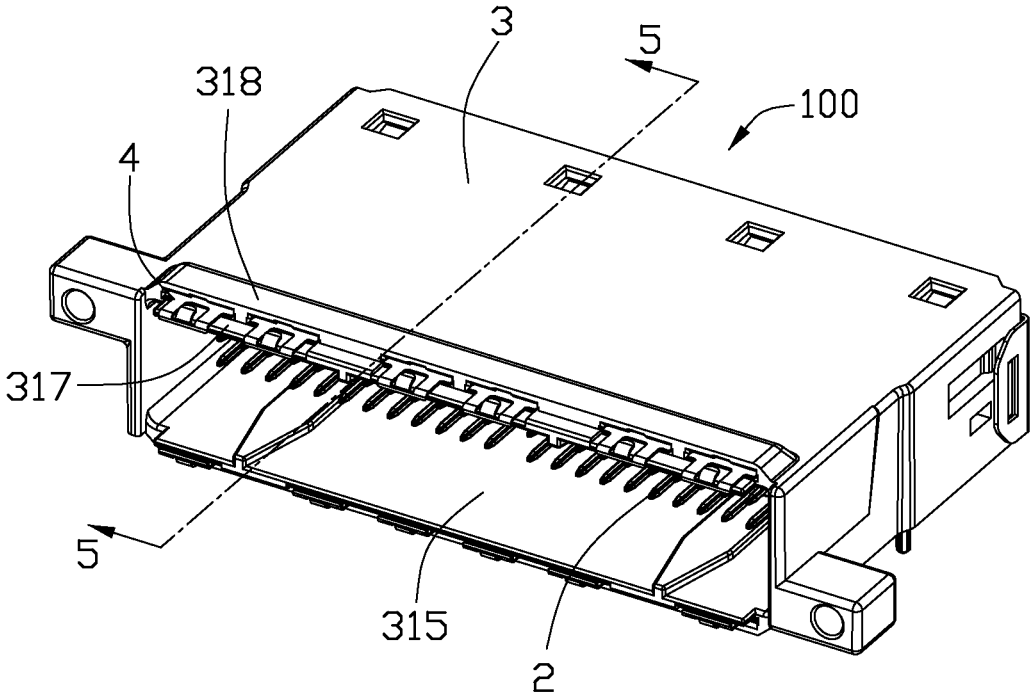
FIG. 1 is an assembled perspective view of an electrical connector according to a preferred embodiment of the present invention.

Reference will now be made to the drawing figures to describe the preferred embodiment of the present invention in detail.

Figure 2:
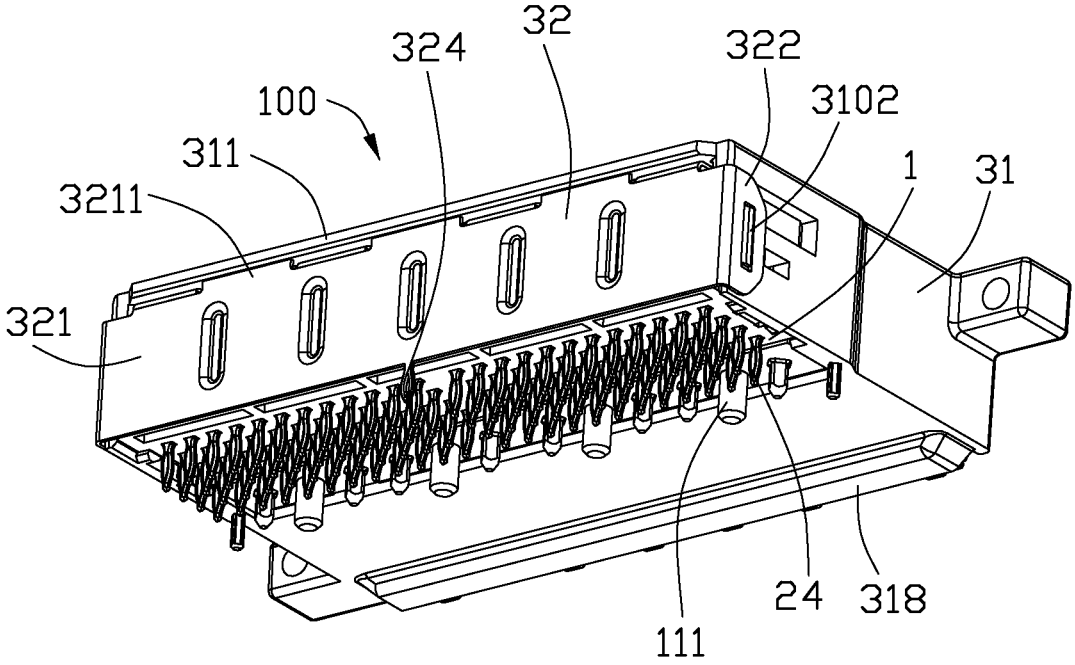
FIG. 2 is another assembled perspective view of the electrical connector as shown in FIG. 1, taken from a rear side.

Referring to FIGS. 1-2, an electrical connector 100 adapted to mounted behind a panel having corresponding mating opening, comprises an insulative housing 1, a plurality of contacts 2 received in the insulative housing 1 for electrically contacting with a mating connector (not shown) through the mating opening of the corresponding panel, a metal shell 3 enclosing in the insulative housing 1 and a plurality of grounding plate 4 mounted to a front of the metal shell 3 for contacting with the mating connector electrically.

Figure 3:
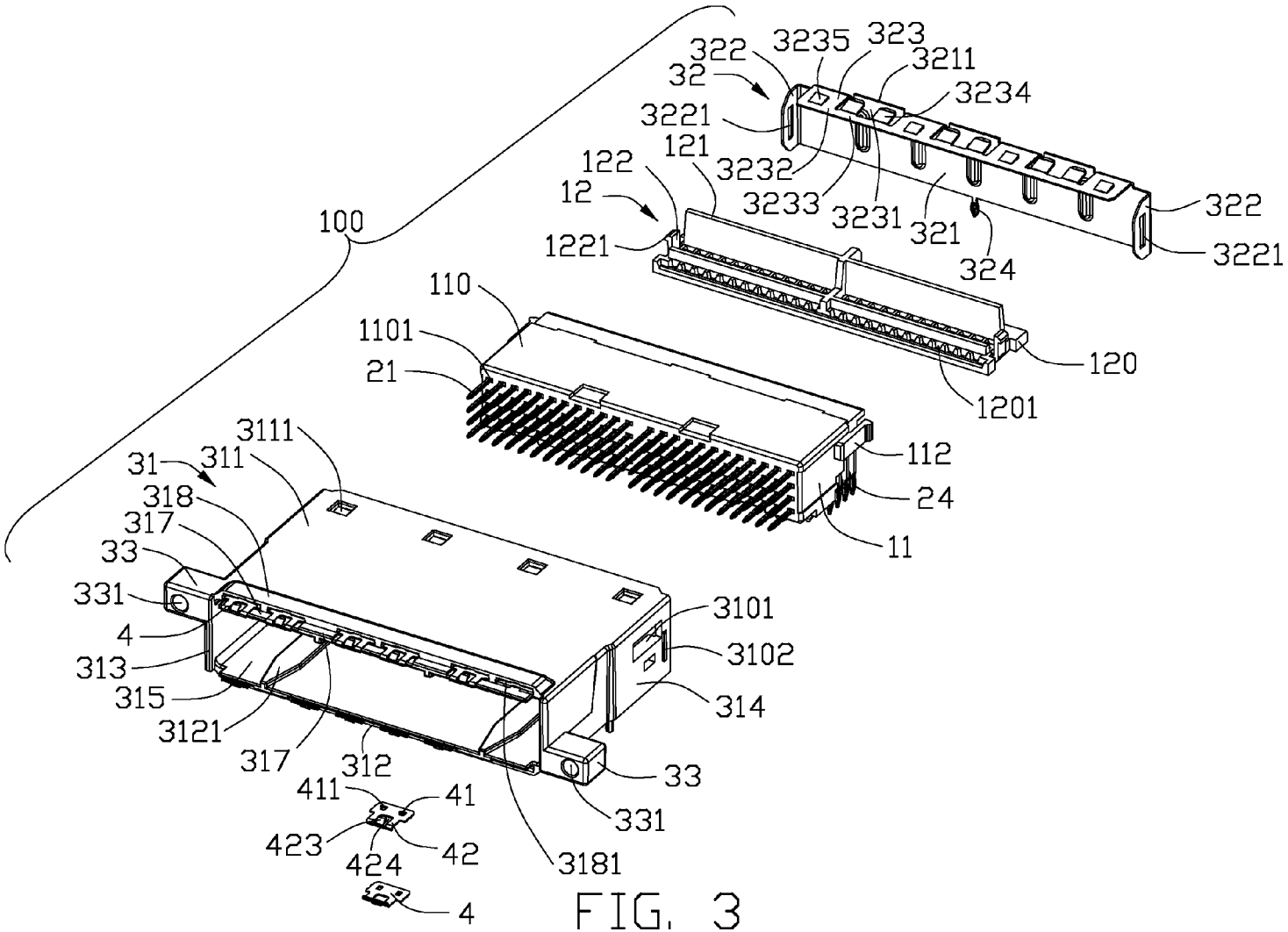
FIG. 3 is an exploded perspective view of the electrical connector.
Figure 4:
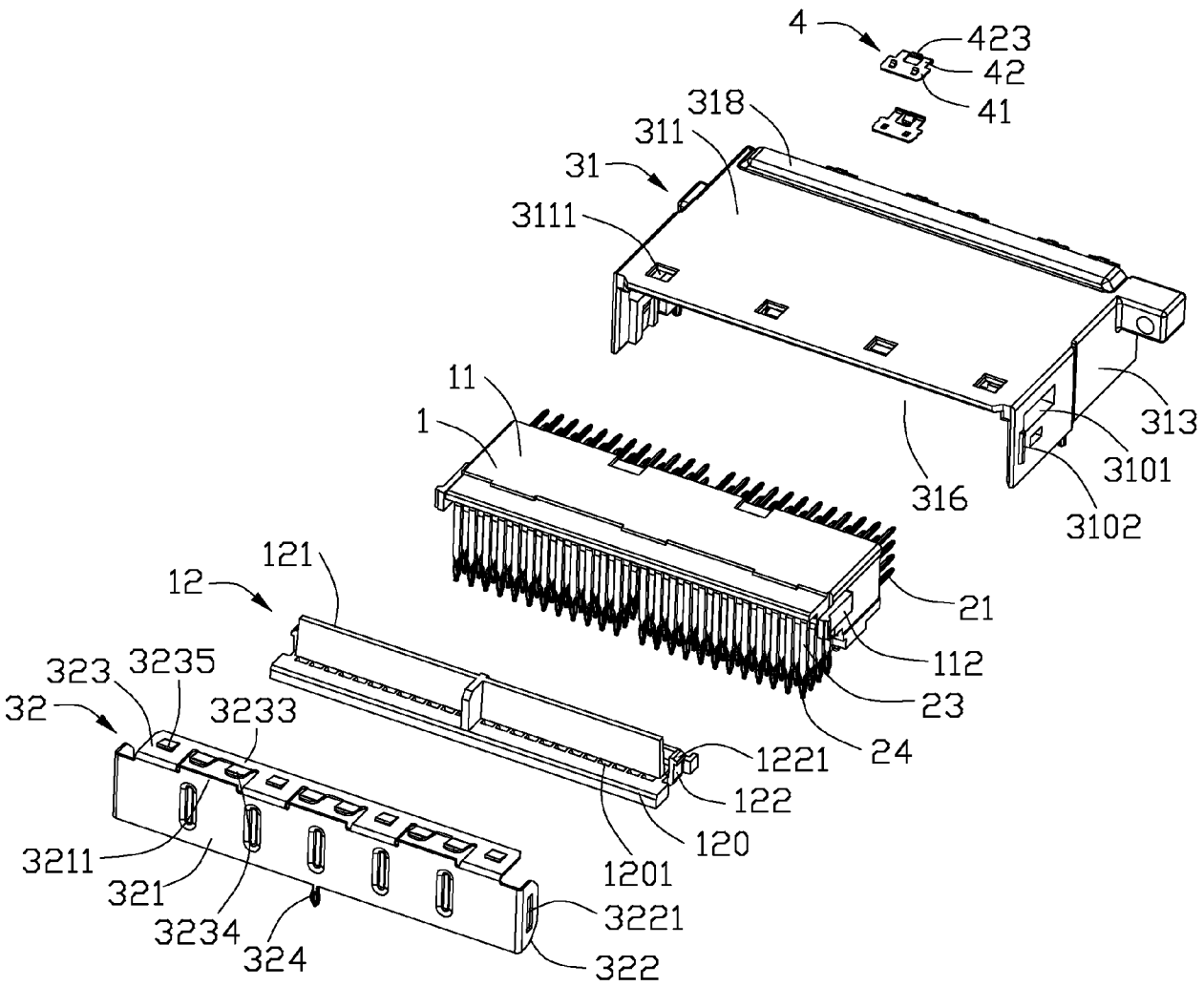
FIG. 4 is another exploded view of the electrical connector as shown in FIG. 3.
Figure 5:
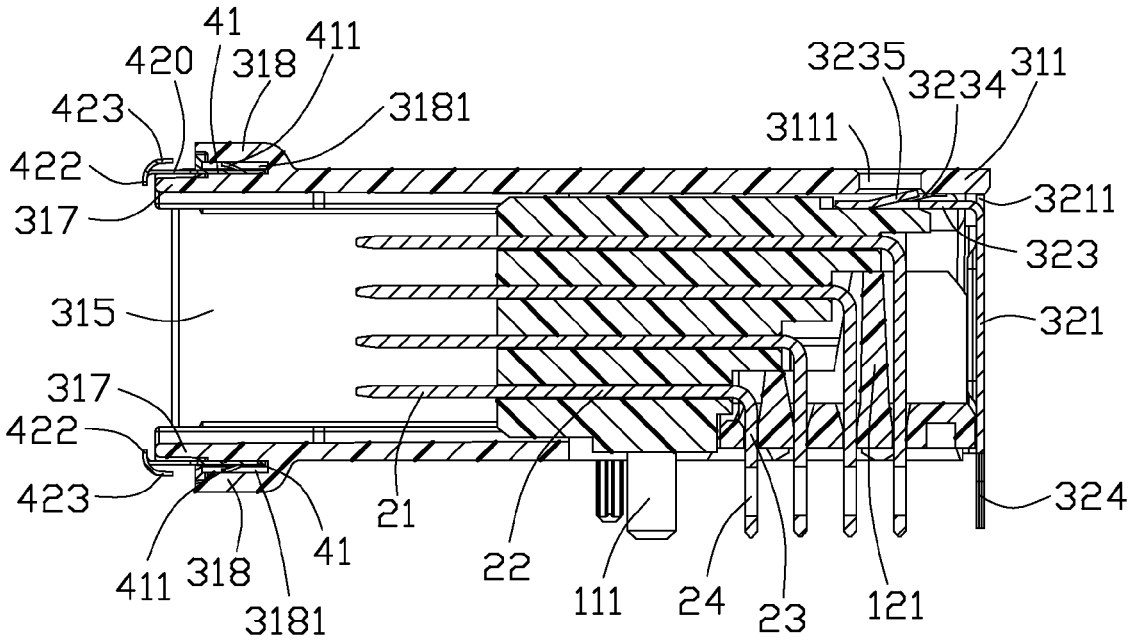
FIG. 5 is a cross-sectional view of the electrical connector, taken along line 5-5 of FIG. 1.

Referring to FIGS. 3-5, the insulative housing 1 has a first body portion 11 disposed as a rectangular shape and a spacer 12 located behind the first body portion 11. The first body portion 11 includes a main body 110, a plurality of retaining posts 111 extending downwardly from a bottom surface of the main body 110 and a pair of first latching arms 112 extending backwardly from two sides of the main body 110. The main body 110 includes a plurality of receiving slots 1101 passing therethrough backwardly from a front end surface thereof.

The space 12 includes a horizontal base board 120, a separating plate 121 extending upwardly form a middle of the base board 120 and two second latching arms 122 extending upwardly from two ends of the base board 120. The second latching arm 122 has a hook 1221 extending from an outside of a top end thereof. The base board 120 has a plurality of retaining holes 1201 passing therethrough along an upper to lower direction. The retaining holes 1201 are disposed into two rows along a front to rear direction. The separating plate 121 is located between two rows of the retaining holes 1201.

The contact 2 includes a retaining portion 22 received in the receiving slot 1101 of the first body portion 11, a contacting portion 21 extending forwardly from an end of the retaining portion 22 horizontally and extending out of the receiving slot 1101, an extending portion 23 extending downwardly and vertically from the other end of the retaining portion 22 and a mounting portion 24 extending downwardly from the extending portion 23. The extending portion 23 is received in the retaining hole 1201 of the spacer 12. The mounting portion 24 is disposed as a fisheye shape and extending out of the spacer 12 downwardly. The separating plate 121 is located between two rows of the extending portion 23 and abuts against a rear of the main body 110 of the first body portion 11 upwardly.

Referring to FIGS. 3-4, the metal shell 3 includes a front shell 31 and a rear shell 32 assembled to the front shell 31. The front shell 31 has a top wall 311, a bottom wall 312 opposite to the top wall 311 and two opposite left and right side walls 313, 314 connecting with the top and bottom walls 311, 312. The top wall 311, the left and right side walls 313, 314 extend backwardly beyond the bottom wall 312. An inserting space 315 is formed by the top, bottom, left and right side walls 311, 312, 313, 314, a mounting hole 316 is formed by parts of the top, left and right side walls 311, 313, 314 extending beyond the bottom wall 312, and the mounting space 316 is formed behind the inserting space 315 and communicated with the inserting space 315. Each of the top and bottom walls 311, 312 has an extending wall 317 extending forwardly from a front edge thereof and an assembling portion 318 protruding outwardly from an outer surface thereof. The assembling portion 318 has a plurality of accommodating slots 3181 depressed backwardly from a front face thereof. The top wall 311 has a plurality of latching holes 3111 passing therethrough along an upper to lower direction. The left and right side walls 313, 314 each have a locking slot 3101 passing therethrough and a convex 3102 protruding outwardly therefrom and located behind the locking slot 3101.

The insulative housing 1 is assembled into the mounting space 316 of the front shell 31 along a front-to-back direction. A part of the insulative housing 1 extends into the inserting space 315. The contacting portion 21 of the contact 2 is located in the inserting space 315. The first latching arms 112 of the first body portion 11 latch with the latching slots 3101 of the front shell 31 to prevent the first body portion 11 from moving forwardly and rearward. The hooks 1221 of the spacer 12 latch with an inner surface of the left and right side walls 313, 314 to prevent the insulative housing 1 from moving upwardly and downwardly. The mounting portions 24 of the contact 2 extend downwardly beyond the bottom wall 312 of the front shell 31. The bottom wall 312 of the front shell 31 has a pair of guiding portions 3121 extending into the inserting space 315 to guide a mating connector to insert therein for preventing an upside down mis-mating. Two blocks 33 extend outwardly from an upper of the left side wall 313 and a bottom of the right side wall 314. The blocks 33 has a mounting hole 331 passing therethrough along the front-to-back direction.

The rear shell 32 includes an upright covering plate 321, two latching portions 322 extending forwardly two sides of the covering plate 321, shielding plate 323 extending forwardly and vertically from a top edge of the covering plate 321 and a plurality of soldering portions 324 disposed as a fisheye shape and extending downwardly from a bottom edge of the covering plate 321. The shielding plate 323 has a plurality of passageway slot 3231 passing therethrough along an upper to lower direction. The passageway slots 3231 separate the shielding plate 323 to form a plurality of extending plates 3232 and a plurality of connecting plates 3233 connecting with two adjacent extending plates 3232. The connecting plate 3233 has an elastic plate 3234 extending backwardly and aslant therefrom. The elastic plate 3234 is located upon the passageway slot 3231. The covering plate 321 has a plurality of resisting portions 3211 extending upwardly from the top edge of the covering plate 321 and located behind the elastic plate 3234. The extending plate 3232 has a plurality retaining plates 3235 tearing upwardly therefrom, the latching portions 322 each have a latching slot 3221 passing therethrough. Further referring to FIG. 5, the rear shell 32 is assembled into a rear of the front shell 31 along a back-to-front direction. The shielding plate 323 is received in an inner of the front shell 31 and abuts against the front shell 31 upwardly. The latching portions 322 latch with the outer surface of the left and right side walls 313, 314. The convexes 3102 of the left and right side walls 313, 314 latch with the latching slot 3221 of the latching portion 322. The retaining plates 3235 of the shield plate 323 are received in the latching holes 3111 of the front shell 31 and abut against the top wall 311 of the front shell 31. The elastic plates 3234 of the shielding plate 323 resist the inner of the front shell 31 upwardly and elastically. The resisting portions 3211 of the covering plate 321 resist a rear edge of the top wall 311 of the front shell 31 upwardly.

Figure 6:
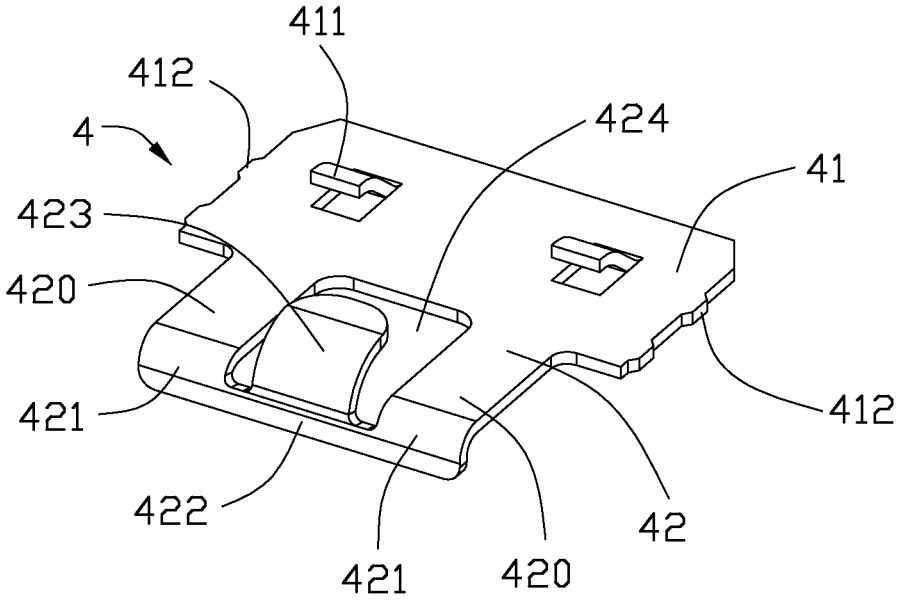
FIG. 6 is a perspective view of a grounding plate of the electrical connector as shown in FIG. 1.
Figure 7:
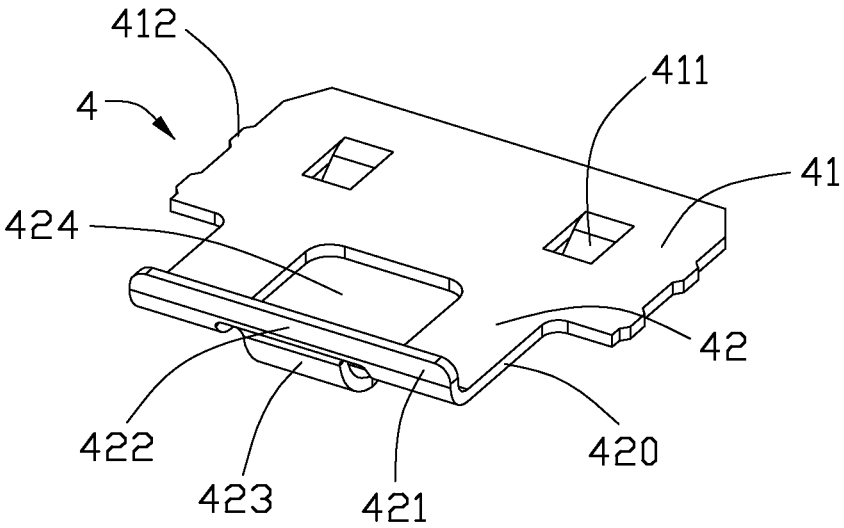
FIG. 7 is similar with FIG. 6, but taken from another side.

Referring to FIGS. 5-7, the grounding plate 4 includes a horizontal base portion 41 and a protruding portion 42 extending forwardly from the base portion 41. The protruding portion 42 has a pair of horizontal portions 420 symmetrically, two bending portions 421 bent downwardly from a front of each horizontal portion 420, an attaching portion 422 connecting with the two bending portions 421 and an elastic mating portion 423 extending backwardly from a middle of a top edge of the attaching portion 422. A through hole 424 is formed by the horizontal portion 420, two bending portion 421 and the attaching portion 422. The mating portion 423 extends upwardly beyond the base portion 41 and is located upon the through hole 424. The base portion 41 has two locking barbs 411 tearing upwardly therefrom and a plurality of barbs 412 extending from two sides of thereof.

Referring to FIGS. 3, 5 and 6, the grounding plates 4 are assembled into the accommodating slots 3181 of the front shell 31. The base portion 41 of the grounding plate 4 is received in the accommodating slot 3181, the protruding portion 42 extending forwardly out of the accommodating slot 3181, the barbs 412 latches with an inner surface of the accommodating slot 3181 to retain the grounding plate 4 in the accommodating slot 3181, the locking barb 411 is received in the inner surface of the accommodating slot 3181 and resists the inner surface of the accommodating slot 3181 upwardly and elastically. The horizontally portion 420 of the protruding portion 42 resists the extending wall 317 of the front shell 31 downwardly and extends forwardly beyond the extending wall 317. The bending portion 421 is located in a front of the extending wall 317, the mating portion 423 extends backwardly and is located outside of the extending wall 317 of the front shell 31 to abut against the mating connector.

The electrical connector 100 includes the assembling portion 318 extending forwardly from the front edge of the metal shell 3. The accommodating slot 3181 depressed backwardly from the front face of the assembling portion 318. The base portion 41 of the grounding plate 4 is assembled into the accommodating slot 3181 and the protruding portion 42 extends out of the accommodating slot 3181 forwardly. The protruding portion 42 has the mating portion 423 extending backwardly therefrom for connecting with the mating connector. The grounding plate 4 would be easily assembled to the metal shell 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

a plurality of contacts received in the insulative housing;

a metal shell enclosing the insulative housing and having a front shell having a top wall and at least one assembling portion protruding outwardly from a front of the top wall, the assembling portion having an accommodating slot; and at least one grounding plate assembled to the metal shell for abutting against a mating connector, the grounding plate having a base portion mounted in the accommodating slot and a protruding portion extending forwardly from the base portion and out of the accommodating slot, the protruding portion having an elastic mating portion disposed above the top wall for contacting with the mating connector;

wherein the base portion of the grounding plate has a plurality of barbs protruding from two sides thereof to latch with an inner surface of the accommodating slot.

2. An electrical connector assembly for mounting to a panel with therein a mating opening defining transverse sides and vertical sides thereof, comprising:

an insulative housing associated with a plurality of contacts, each of said contacts defining a front mating section and a rear mounting section;

a shield device surrounding said housing and defining a mating port forwardly communicating with an exterior in a front-to-back direction and receiving said front mating sections therein;

said mating port defining generally a rectangular cross-section with a pair of long sides extending along a transverse direction perpendicular to said front-to-back direction, and a pair of short sides extending in a vertical direction perpendicular to both said front-to-back direction and said transverse direction;

a plurality of discrete grounding plates attached to a front edge of each of said long sides for alignment with the corresponding transverse side of the mating opening; and a pair of fastening blocks located on exterior faces of said pair of short sides for mounting to the panel around the vertical sides; wherein said pair of fastening blocks are arranged offset from each other in the vertical direction for allowing densely side-by-side arrangement of more than one connectors in the transverse direction.

3. The electrical connector as claimed in claim 1, wherein the base portion of the grounding plate has at least one locking barb tearing upwardly therefrom and extending forwardly and aslant to interfere with the accommodating slot.

4. The electrical connector as claimed in claim 1, wherein the protruding portion of the base portion includes a pair of horizontal portions symmetrically, two bending portions bent downwardly from a front of each horizontal portions and an attaching portion connecting with the two bending portions.

5. The electrical connector as claimed in claim 4, wherein a through hole is formed by the horizontal portions, the bending portions and the attaching portion, the mating portion of the grounding plate extends backwardly and aslant and is located upon the through hole.

6. The electrical connector as claimed in claim 4, wherein the front shell has a bottom wall opposite the top wall and two opposite left and right side walls connecting with the top and bottom wall, the bottom wall also has at least one assembling portion.

7. The electrical connector as claimed in claim 6, wherein both of the top and bottom walls have an extending wall extending forwardly therefrom and located in a front of the assembling portion, the protruding portion of the grounding plate extends forwardly beyond a front edge of the extending wall, the horizontal portion of the grounding plate abuts against the extending wall and the bending portion is located in a front of the extending wall.

8. The electrical connector as claimed in claim 6, wherein the top wall, the left and right side walls extend backwardly beyond the bottom wall, an inserting space is form by the top wall, bottom wall, left and right side walls and a mounting space is defined by the top wall, the left and right side wall and communicated with the inserting space, the insulative housing is assembled into the mounting space and a part of the insulative housing extending into the inserting space.

9. The electrical connector as claimed in claim 8, wherein the insulative housing have a first body portion and a spacer located behind the first body portion, the spacer includes a base board having a plurality of retaining holes passing therethrough along an upper to lower direction, the contact includes an extending portion extending downwardly and vertically and received in the retaining hole and a mounting portion extending downwardly from the extending portion and extending out of the retaining hole.

10. The electrical connector as claimed in claim 8, wherein the metal shell further includes a rear shell mounted to the front shell, the rear shell has a vertical covering plate and a shield plate extending forwardly and horizontally from a front edge of the covering plate, the covering plate is received in the mounting space and abuts against an inner face of the top wall of the front shell upwardly.

11. The electrical connector as claimed in claim 10, wherein the rear shell further includes a pair of latching portions extending forwardly from two sides thereof, the latching portions latch with outside surfaces of the left and right side walls, the left and right side walls of the front shell have convex extending outwardly therefrom, the latching portion has a latching slot passing therethrough and the convex is received in the latching slot.

12. An electrical connector comprising:

an insulative housing;

a plurality of the contacts received in the insulative housing; and a metal shell enclosing the insulative housing and having a front shell and a rear shell mounted to the front shell, the front shell having a top wall, the rear shell having a vertical covering plate shielding a rear of the front shell and a shielding plate extending forwardly from a top of the covering plate, the shielding plate having an elastic plate abutting against the top wall of the front shell, the covering plate further having a resisting portion extending upwardly from the top thereof, an end of the resisting portion upwardly abutting against the top wall of the front shell.

13. The electrical connector as claimed in claim 12, wherein the resisting portion is located behind the elastic plate.

14. The electrical connector as claimed in claim 12, wherein the resisting portion extends upwardly beyond the shielding plate and abuts against the top wall of the front shell.

15. The electrical connector as claimed in claim 12, wherein the rear shell has a plurality of soldering portions extending downwardly therefrom.

16. The electrical connector assembly as claimed in claim 2, wherein the shield device defines at least one guiding portion formed in an interior surface thereof, and said rib structure defines a tapered configuration around a front portion of the mating port.

17. The electrical connector assembly as claimed in claim 2, wherein one of said pair of fastening blocks is essentially flush with one of the pair of long sides while the other of said pair of fastening blocks is essentially flush with the other of the pair of long sides.

18. The electrical connector assembly as claimed in claim 2, wherein each of said grounding plate defines a spring tang located at a first position in the front-to-back direction and each of said fastening blocks is located at a second position in said front-to-back direction, said first position is in front of said second position in said front-to-back direction so that said spring tangs are located inside of the mating opening while said fastening blocks are located outside and behind said mating opening when said connector is mounted to the panel.

19. The electrical connector assembly as claimed in claim 2, wherein said shield device defines slots around the front edges of the long sides into which said grounding plates are assembled.

* * * * *